US008133328B2

(12) United States Patent
Delaney et al.

(10) Patent No.: US 8,133,328 B2
(45) Date of Patent: Mar. 13, 2012

(54) ROTARY APPARATUS AND METHOD FOR CLEANING LIQUID STORAGE TANKS

(75) Inventors: Robert E. Delaney, Kennett Square, PA (US); Andrew K. Delaney, West Chester, PA (US); Bentley F. Gleeson, Plymouth Meeting, PA (US); Minh Q. Le, Fairfax, VA (US)

(73) Assignee: Gamajet Cleaning Systems Inc., Exton, PA (US)

( * ) Notice: Subject to any disclaimer, the term of this patent is extended or adjusted under 35 U.S.C. 154(b) by 399 days.

(21) Appl. No.: 12/231,480

(22) Filed: Sep. 3, 2008

(65) Prior Publication Data

US 2010/0051057 A1 Mar. 4, 2010

(51) Int. Cl.
*B08B 9/20* (2006.01)
*B05B 3/04* (2006.01)

(52) U.S. Cl. ..... 134/167 R; 134/166 R; 239/227; 239/240; 239/243

(58) Field of Classification Search ..... 134/166 R, 134/167 R, 168 R, 169 R; 239/227, 240, 239/243, 225.1
See application file for complete search history.

(56) References Cited

U.S. PATENT DOCUMENTS

| | | | | |
|---|---|---|---|---|
| 5,169,069 | A * | 12/1992 | Rucker et al. | 239/227 |
| 5,301,702 | A * | 4/1994 | McKinney | 134/167 R |
| 5,332,155 | A * | 7/1994 | Jager | 239/240 |
| 6,123,271 | A * | 9/2000 | Delaney et al. | 239/227 |
| 6,561,199 | B2 | 5/2003 | Gleeson et al. | |
| 6,945,471 | B2 * | 9/2005 | McKenzie et al. | 239/237 |
| 2004/0238009 | A1 * | 12/2004 | Falster-Hansen et al. | 134/22.1 |

* cited by examiner

*Primary Examiner* — Michael Barr
*Assistant Examiner* — Saeed T Chaudhry
(74) *Attorney, Agent, or Firm* — Michael R. Philips

(57) ABSTRACT

A rotary apparatus and method is provided for cleaning liquid storage tanks, particularly above ground tanks. The rotary cleaning apparatus includes a Tee housing that is rotated around a vertical axis and a nozzle housing mounted to the Tee housing for rotation around a horizontal axis, resulting in a 360° spherical spray pattern. A set of downspray nozzles is mounted to the Tee housing at an angle to the vertical axis to rotate with the housing and generate a conical spray pattern. In the preferred embodiment, the apparatus draws liquid stored in the tank through a filter and pumps the filtered liquid through the rotary cleaning apparatus.

10 Claims, 6 Drawing Sheets

ROTARY APPARATUS AND METHOD FOR CLEANING LIQUID STORAGE TANKS

FIELD OF THE INVENTION

The present invention relates to the field of devices for cleaning liquid storage tanks and particularly to devices and methods for cleaning above ground liquid storage tanks using the method known as rotary impingement cleaning.

BACKGROUND OF THE INVENTION

Vessels such as above ground liquid storage tanks require periodic cleaning to remove debris, sediment, algae and other contaminants that accumulate on the interior surfaces thereof, particularly on the bottom areas of the tank. Above ground liquid storage tanks, e.g. fuel tanks, may be as large as 5 feet in diameter by 8 feet long. Diesel fuel in particular has a tendency to encourage the growth of algae on the tank walls and floating in the stored fuel. Remediation of algae or other contaminants in the stored liquid requires periodic polishing, i.e. clarifying filtration, of the stored liquid. Polishing involves pumping the liquid out of the tank, through a filter and back into the tank, possibly running the process over a period of time until the liquid is free of particulate. Devices have been developed to efficiently clean tank interior walls without a person manually scrubbing the tank interior. For example, one tank cleaning device has multiple nozzles that rotate simultaneously around two mutually perpendicular axes and discharge pressurized streams of a liquid directed at the interior surface of the tank. The streams impinge on the interior tank surface to dislodge and wash away contaminants and general residue from the interior surface. This cleaning technique is commonly referred to as rotary impingement cleaning. Devices that perform rotary impingement cleaning are described in U.S. Pat. Nos. 6,123,271 and 6,561,199.

However, above ground storage tanks typically have small access ports, on the order of 2 inches in diameter. Known rotary impingement cleaning machines capable of thoroughly cleaning tanks as large as typical above ground storage tanks are generally too large to be inserted through a 2 inch opening. Therefore, a need exists for a device that can be inserted into a 2 inch opening that is capable of effectively cleaning the interior of above ground liquid storage tanks, especially including particulate residue on the tank bottom.

SUMMARY OF THE INVENTION

A rotary apparatus and method for cleaning a liquid storage tank is disclosed. The apparatus has a Tee housing that is rotated around a vertical axis with a rotary nozzle housing and a pair of downspray nozzles assembled thereto. The downspray nozzles are oriented at fixed angles to the vertical axis to spray downward to agitate residue deposited on the tank bottom. The downspray nozzles rotate with the Tee housing around the vertical axis. The nozzle housing is mounted to the Tee housing in a vertical plane to rotate around a horizontal axis and has a number of radial nozzles positioned around the periphery. The rotation of the Tee housing and the rotation of the nozzle housing are driven by a shaft connected to a gear train that is driven by a liquid pumped through a rotor, the gear train being located outside of the tank being cleaned. The liquid is drawn from the tank bottom through a suction hose by a pump and filter to complete a closed system. The filter removes the particulate from the liquid being circulated. The process is continued until the liquid is polished to become free of particulate.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
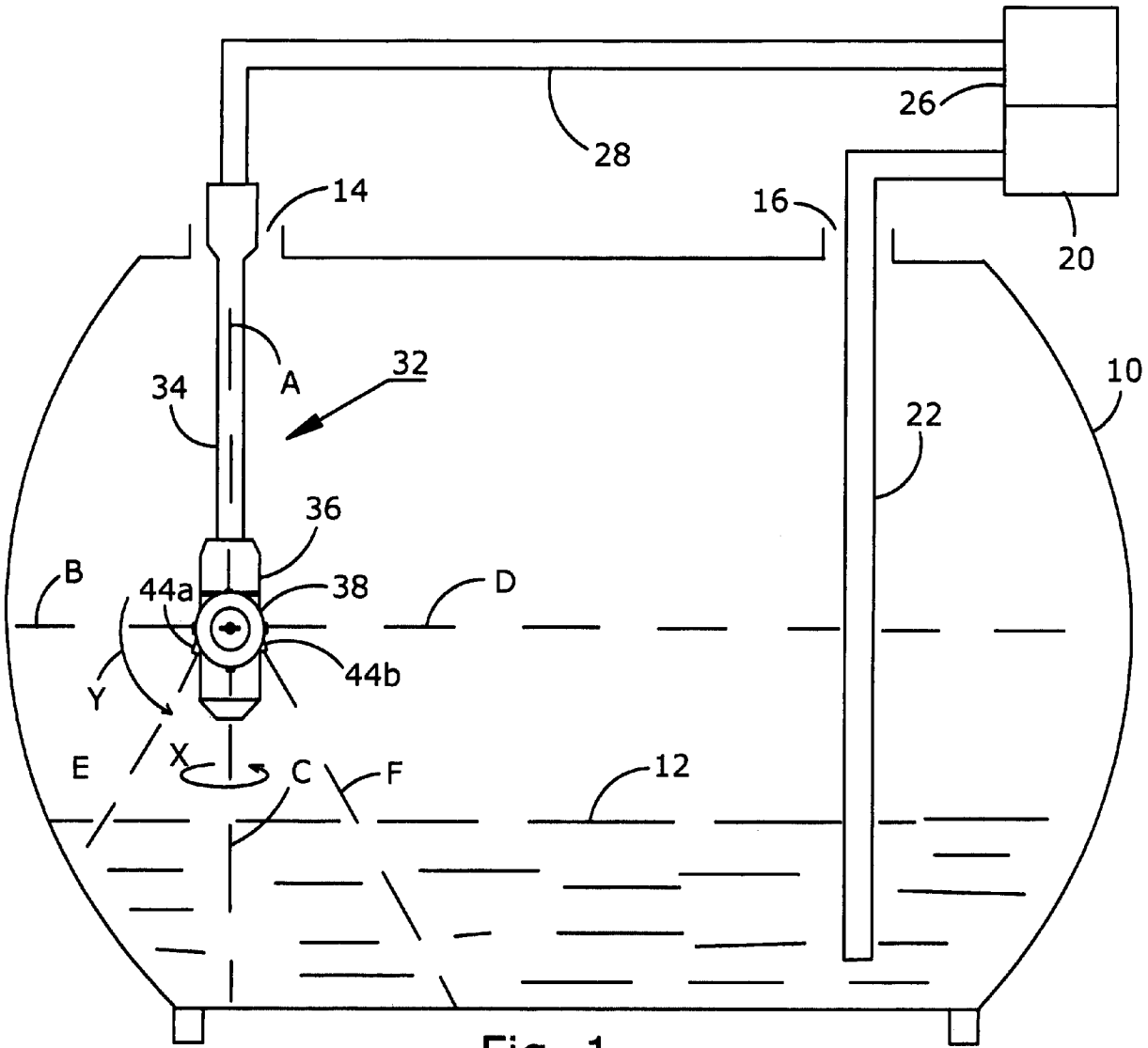
FIG. 1 is a schematic side elevation view of a liquid storage tank with the rotary cleaning apparatus of the invention positioned through a first access port and a suction hose positioned through a second access port thereof.

Referring now to FIG. 1, a liquid storage tank 10 is illustrated in schematic side elevation view. Tank 10 is of the type of liquid storage tank that is typically positioned above ground and is up to approximately 5 feet in diameter by 8 feet in length, thus having a maximum capacity of approximately 1250 gallons. Whereas the embodiment described herein relates mainly to above ground storage tanks, it is understood that the apparatus and method of the invention pertains similarly to buried tanks. Tank 10 has a first access port 14 adjacent to a first end thereof and a second access port 16 adjacent to a second end thereof. As noted above, the access ports of above ground storage tanks is typically 2 inches in diameter. Tank 10 may be used for the storage of diesel fuel or other liquids. It is necessary to clean the interior surface of tank 10 periodically to remove particulate matter that may adhere to the interior surface and most particularly that is deposited on the bottom of tank 10. Tank 10 may be cleaned by removing all of the liquid from tank 10 and using a cleaning liquid, e.g. a detergent solution. According to the preferred embodiment, tank 10 is cleaned by using the liquid 12 stored in tank 10 as the cleaning medium and simultaneously filtering the particulate out of the circulated liquid 12. The process of cleaning tank 10 is best accomplished when the volume of liquid 12 is reduced to 25% or less of the capacity of the tank to permit particulate residue below the top level of liquid 12 to become agitated and dispersed in liquid 12.

Referring further to FIG. 1, a suction hose or pipe 22 is positioned through port 16 with the lower end of pipe 22 positioned within liquid 12. The upper end of suction pipe 22 is connected to a filter 20 that is connected to a pump 26. Pump 26 may be a self-priming centrifugal pump, as is known. Pump 26 draws liquid 12 from the bottom of tank 10 through suction pipe 22 and through filter 20 to remove particulate, residue and contaminants from liquid 12. When liquid 12 is a fuel, e.g. diesel fuel, the process of circulating liquid 12 through a filter and back to storage tank 10 is known in the industry as polishing. Liquid 12 is pumped through a pressure hose or pipe 28 to rotary cleaning apparatus 32. Liquid 12 flows through a tube 34 of rotary cleaning apparatus 32 to rotary cleaning head 36. Cleaning head 36 has a pair of downspray nozzles 44*a*, 44*b* residing on opposite sides thereof at an acute angle to vertical, as shown. Cleaning head 36 also has a nozzle housing 38 mounted in vertical orientation. Nozzle housing 38 is configured to emit spray streams A, B, C and D. Downspray nozzles 44*a*, 44*b* emit spray streams E and F. Cleaning head 36 is driven to rotate in the direction indicated by arrow X around a vertical axis, causing spray streams E and F to substantially describe a downwardly directed conical spray. As cleaning head 36 rotates around the vertical axis, nozzle housing 38 rotates in the direction indicated by arrow Y around a horizontal axis, causing spray streams A, B, C and D to describe a spherical 360° pattern, covering the entire interior surface of tank 10. Spray streams E and F spray downward, churning liquid 12 and dislodging particulate residing on the bottom surface of tank 10. The discharged particulate is dispersed in liquid 12 to be carried up through suction pipe 22 and trapped in filter 20, resulting in a cleaner liquid 12 than previously.

Figure 2:
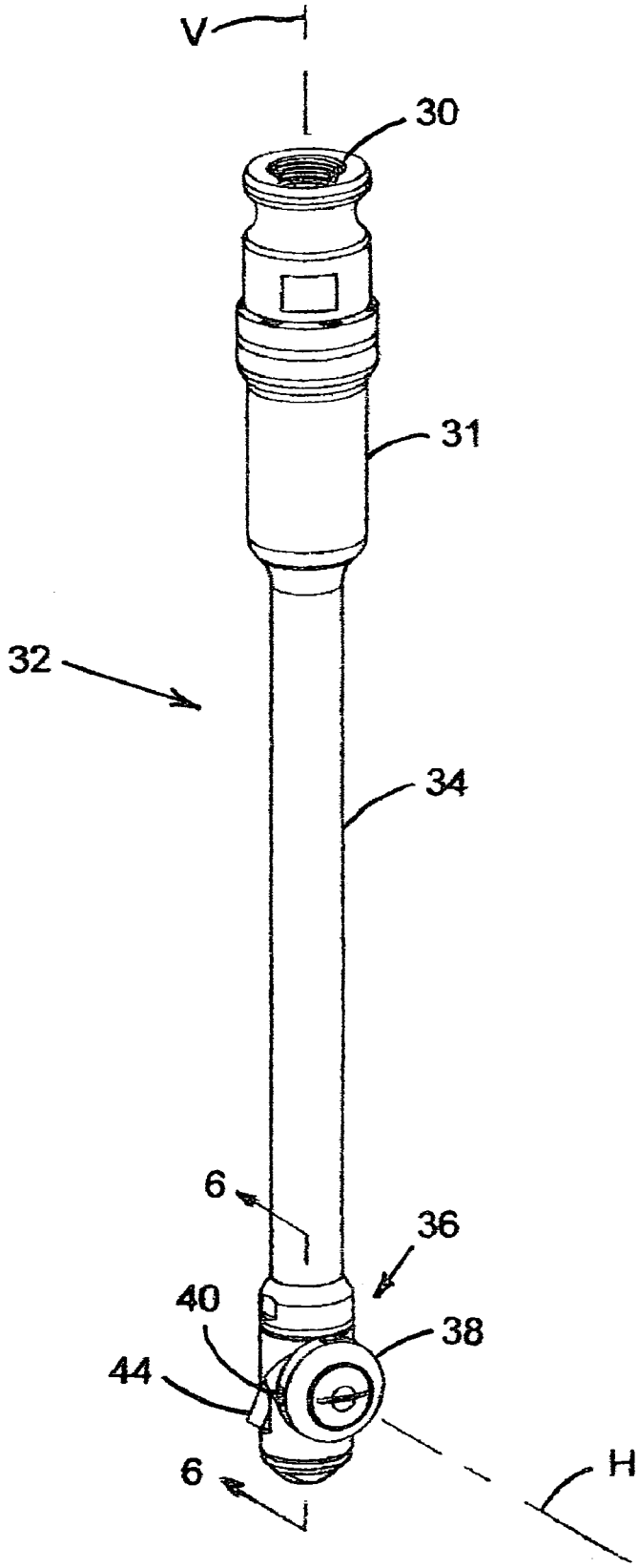
FIG. 2 is a front perspective view of the rotary cleaning apparatus of the present invention.

Referring now to FIG. 2, rotary cleaning apparatus 32 is shown in perspective view. An inlet 30 is formed at the upper end of rotary cleaning apparatus 32. In operation, inlet 30 is connected to a supply of pressurized liquid. As described above, the pressurized liquid is drawn from the tank being cleaned through a filter. A drive housing 31 resides in flow communication with inlet 30 and with a stem 34. Drive housing 31 contains a rotor and a gear train (not shown) actuated by the pressurized liquid flowing from inlet 30 as described in U.S. patent application Ser. No. 11/752,466 incorporated herein by reference. Drive housing 31 is typically kept out of the tank being cleaned. Rotary cleaning head 36 is assembled to the lower end of tube 34 and driven by an elongate shaft (not shown) connected within tube 34 to the gear train. A downspray nozzle 44 is formed on either side (only one visible) of rotary cleaning head 36 and a nozzle housing 38 is mounted in a vertical plane to a side portion of rotary cleaning head 36. Nozzle housing 38 is formed with a plurality of nozzles 40 (only two visible) on a peripheral wall thereof. When driven by the drive train within drive housing 31, rotary cleaning head 36 rotates around vertical axis V and nozzle housing 38 rotates around horizontal axis H. Throughout operation, drive housing 31 and tube 34 remain stationary.

Figure 3:
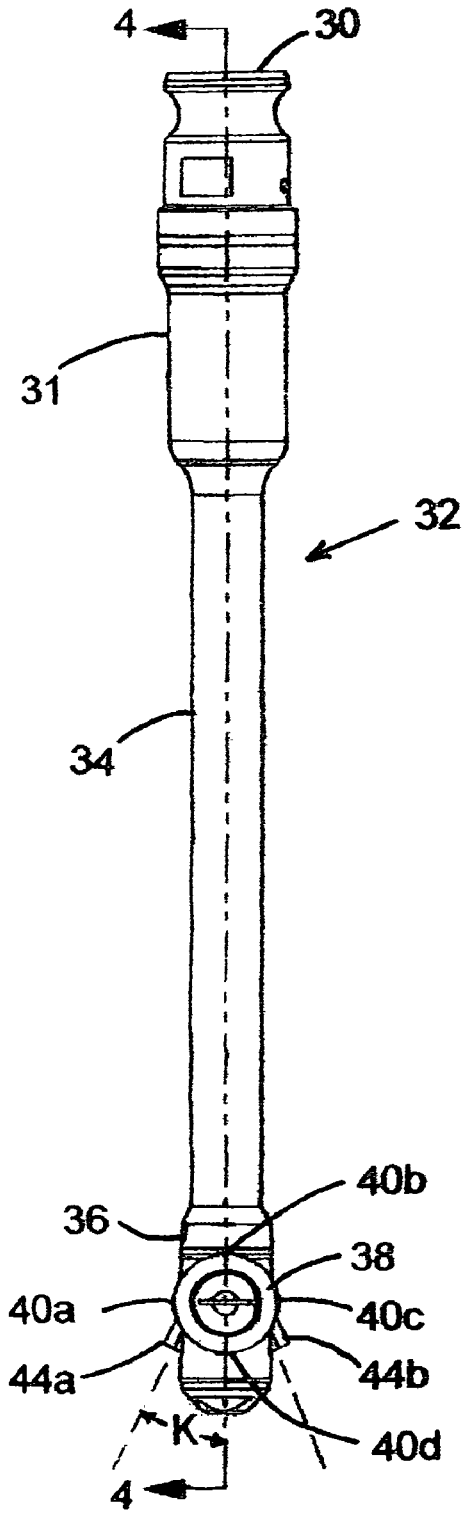
FIG. 3 is a front elevation view of the rotary cleaning apparatus of FIG. 2.

Referring now to FIG. 3, rotating cleaning apparatus 32 is illustrated in front elevation view. As seen in this view, a set of 4 radially oriented nozzles 40*a*, 40*b*, 40*c* and 40*d* are formed on the periphery of rotary nozzle housing 38 substantially at 90° angular separation. Alternate numbers of radial nozzles, e.g. 2 or 3 nozzles, are also deemed to be within the scope of the present invention. A pair of downspray nozzles 44*a* and 44*b* are fixedly formed on opposite side portions of rotary cleaning head 36. In operation, as cleaning head 36 is rotated around vertical axis V, downspray nozzles 44*a*, 44*b* each discharge a spray stream oriented at angle K, approximately 25°, forming a conical spray pattern to agitate particulate residue on the bottom of tank 10 (see FIG. 1). Alternate values for angle K, e.g. from 20° to 45° are considered within the scope of the present invention. At the same time, radial nozzles 40*a*, 40*b*, 40*c* and 40*d* are rotated in the vertical plane around horizontal axis H (see FIG. 2) by nozzle housing 38 and around vertical axis V by rotary cleaning head 36 to cause a 360° spray pattern at substantially all interior surfaces in tank 10 (see FIG. 1).

Figure 4:
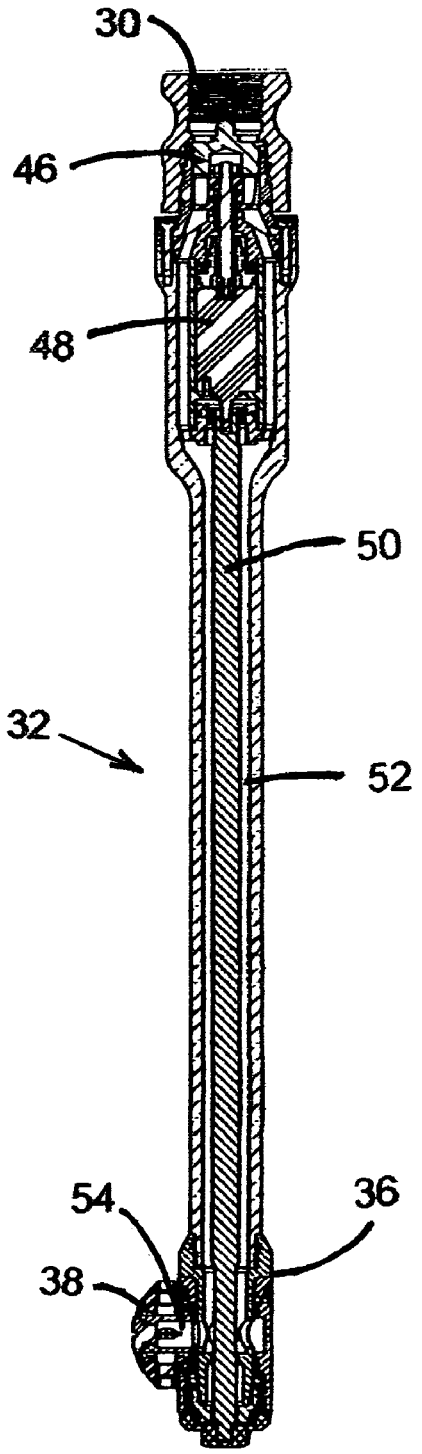
FIG. 4 is a cross sectional view of the rotary cleaning apparatus taken in the direction of line 4-4 of FIG. 3.

Referring now to FIG. 4, a cross sectional view of rotary cleaning apparatus 32 is shown as taken along line 4-4 of FIG. 3. The pressurized liquid enters rotary cleaning apparatus 32 through inlet 30 and passes through a stator 46, causing stator 46 to rotate. Stator 46 is mechanically connected to a gear train 48 that in turn drives a shaft 50, which causes rotary cleaning head 36 to rotate. After passing through stator 46, the liquid travels through tubular channel 52 and cross channel 54 to be discharged as described above through each of radial nozzles 40*a*, 40*b*, 40*c* and 40*d* (see FIG. 3) and through downspray nozzles 44*a*, 44*b* (see FIG. 3).

Figure 5:
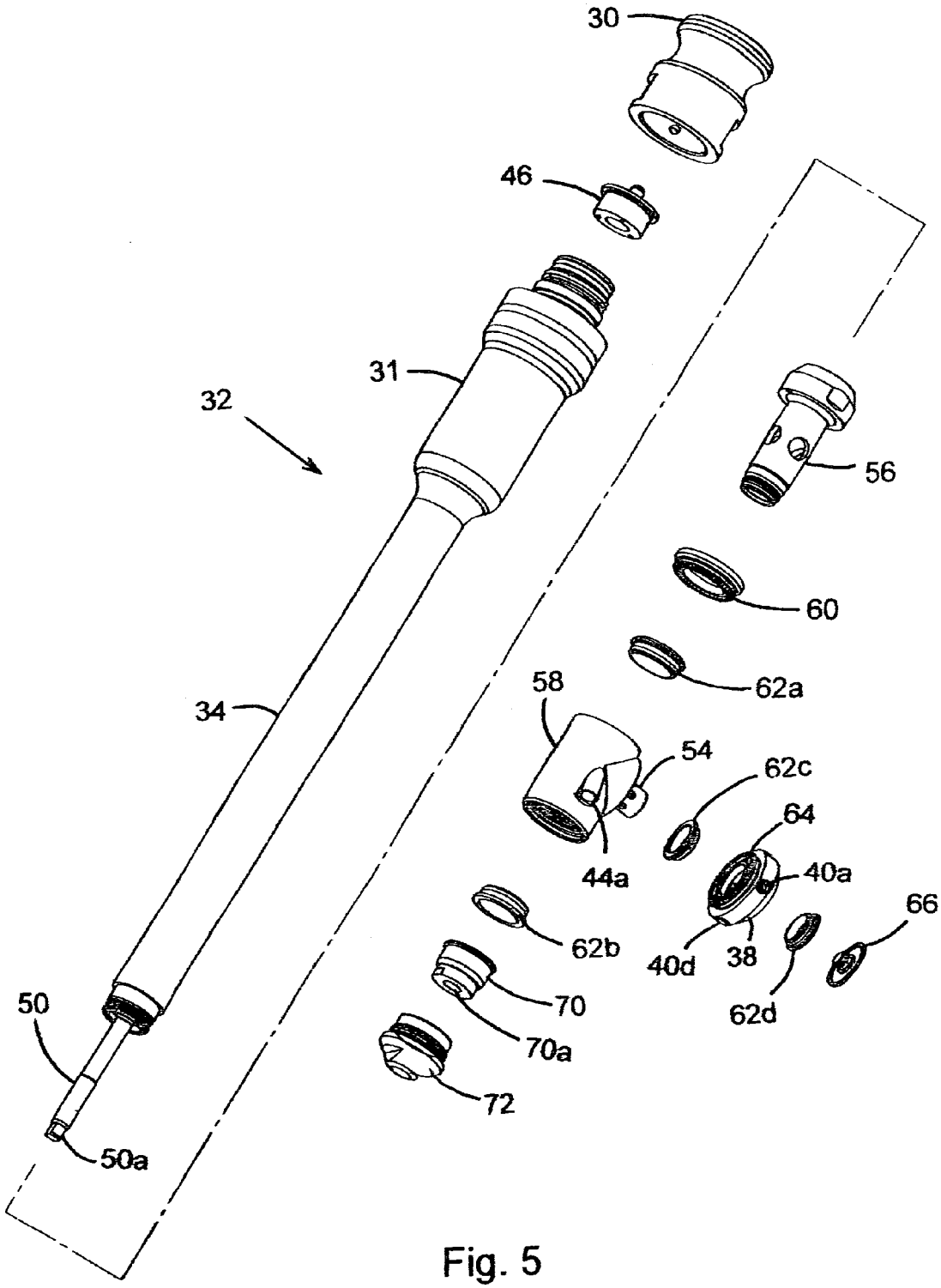
FIG. 5 is an exploded perspective view of the rotary cleaning apparatus of FIG. 2.

Referring now to FIG. 5, an exploded perspective view of rotary cleaning apparatus 32 of FIG. 2 is illustrated. Inlet 30 is formed to enclose a stator 46 that conveys the pressurized liquid to a rotor (not shown), the rotor operating to convert the liquid flow into rotational motion. The rotor connects to a gear train (not shown) that is housed within a drive housing 31 that is connected to a tube 34. A shaft 50, connected at the upper end to the gear train, extends beyond the lower end of tube 34. Shaft 50 passes through stem 56 on which bevel gear 60 is mounted and passes through first bearing 62*a* into Tee housing 58. Stem 56 passes through second bearing 62*b* and threadingly engages a retainer 70 formed with a central opening 70*a* to allow shaft 50 to pass through. The lower end 50*a* of shaft 50 has a non-round configuration to drivingly engage a cap 72. Cap 72 is connected by threads to the lower end of Tee housing 58, transmitting rotation from shaft 50 to Tee housing 58. Thus rotary cleaning apparatus 32 operates by a pressurized liquid causing a rotor (not shown) to rotate, driving a gear train (not shown) that drives shaft 50. Shaft 50 engages cap 72 that is threaded to and rotates Tee housing 58. First bevel gear 60 locks onto stem 56 that does not rotate so as to cause second bevel gear 64 to rotate nozzle housing 38. Therefore, as Tee housing 58 is being rotated around the vertical axis, nozzle housing 38 is rotated around the horizontal axis. By establishing a small difference in diameter between first bevel gear 60 and second bevel gear 64, for example a diameter difference based on a differential of 1 tooth, nozzle housing 38 will rotate at a different rate than Tee housing 58, causing the spherical spray pattern from radial nozzles 40*a*, 40*b*, 40*c* and 40*d* (only 40*a* and 40*d* visible) to advance with each revolution and maximize wall coverage.

Figure 6:
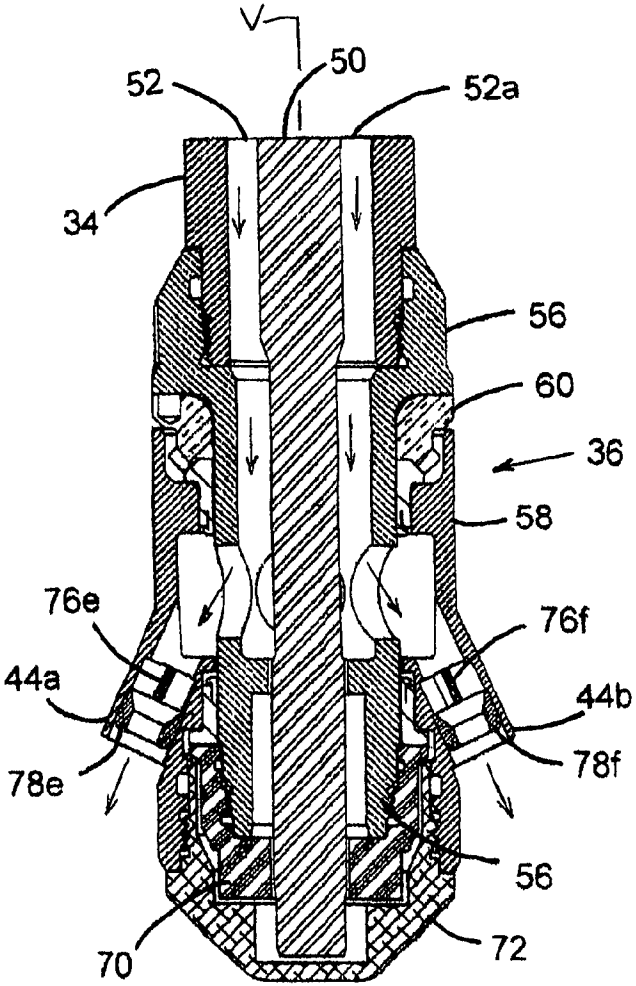
FIG. 6 is a cross sectional view of the rotary housing of the invention taken in the direction of line 6-6 of FIG. 2.

Referring now to FIG. 6, rotary cleaning head 36 is shown in cross sectional view as indicated by line 6-6 of FIG. 2. During operation, tube 34 remains stationary with stem 56 and retainer 70. Shaft 50 imparts rotation to housing 58 through cap 72. Pressurized liquid, indicated by small arrows in channels 52, 52*a*, is discharged through downspray nozzles 44*a*, 44*b* on either side of housing 58. Downspray nozzles 44*a*, 44*b* are each oriented substantially coplanar with vertical axis V. A stream straightener 76*e* and a tubular nozzle insert 78*e* are positioned within first downspray nozzle 44*a*. A stream straightener 76*f* and a tubular nozzle insert 78*f* are positioned within second downspray nozzle 44*b*. Stream straighteners 76*e*, 76*f* are formed as a set of intersecting vanes to minimize turbulence in the pressurized liquid flow being discharged from downspray nozzles 44*a*, 44*b*. Nozzle inserts 78*e*, 78*f* are formed with a tapered entry end to provide a gradual reduction in channel area, thus reducing possible pressure loss, while maintaining maximum flow rate in a cohesive stream. With the smaller exit diameter of nozzles inserts 78*e*, 78*f* causing an increase in the discharge velocity of the pressurized liquid, optimizing the cleaning effectiveness of each spray stream. Depending on the operational conditions, tubular inserts of various inside diameters may be utilized, or no tubular insert is used. Whereas the size of port 14 (see FIG. 1) is severely restricted, the overall diameter of the rotary cleaning apparatus must be kept to a minimum. In prior known rotary cleaning machines, components such as tubular nozzle inserts are formed with external threads and assembled to internal threads within, e.g. downspray nozzles 44*a*, 44*b*. Vaned stream straighteners were assembled within the bore of the tubular nozzle inserts. However, mating sets of threads require additional diameter, limiting the orifice size available. To overcome this size restriction and minimize overall diameter, downspray nozzles 44*a*, 44*b* and nozzle inserts 78*e*, 78*f* are formed without threads and sized to be assembled by an interference, or press fit, with stream straighteners 76e, 76f mounted upstream. A shoulder is provided within each downspray nozzle 44*a*, 44*b* to fixedly position each stream straightener 76*e*, 76*f* and nozzle insert 78*e*, 78*f*. This minimization of diameter allows the rotary cleaning apparatus of the invention to be inserted into a minimum size tank opening while retaining effective fluid flow.

Figure 7:
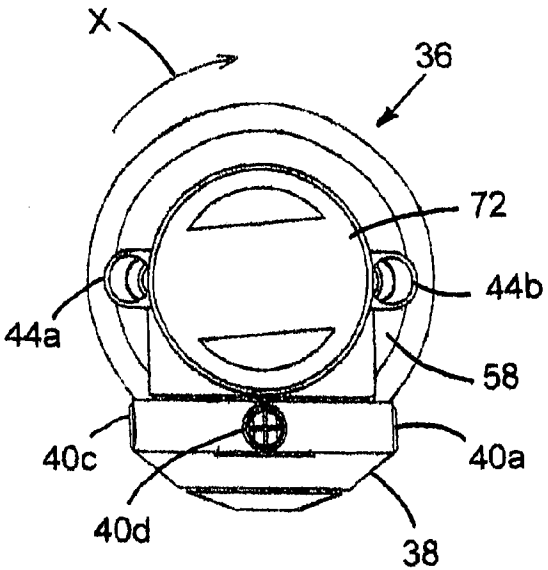
FIG. 7 is a bottom plan view of the cleaning head of the invention.

Referring now to FIG. 7, a bottom plan view is shown of rotary cleaning head 36, especially depicting downspray nozzles 44*a*, 44*b*, rotating nozzle housing 38 and radial nozzles 40*a*, 40*c* and 40*d* (nozzle 40*b* not visible). Cap 72 is seen to have a pair of flat surfaces for being engaged by a wrench or similar tool for tightening or removing. Cleaning head housing 58 and downspray nozzles 44*a*, 44*b* rotate as indicated by arrow X in the plane of FIG. 7 as nozzle housing 38 rotates in a plane perpendicular thereto.

Figure 8:
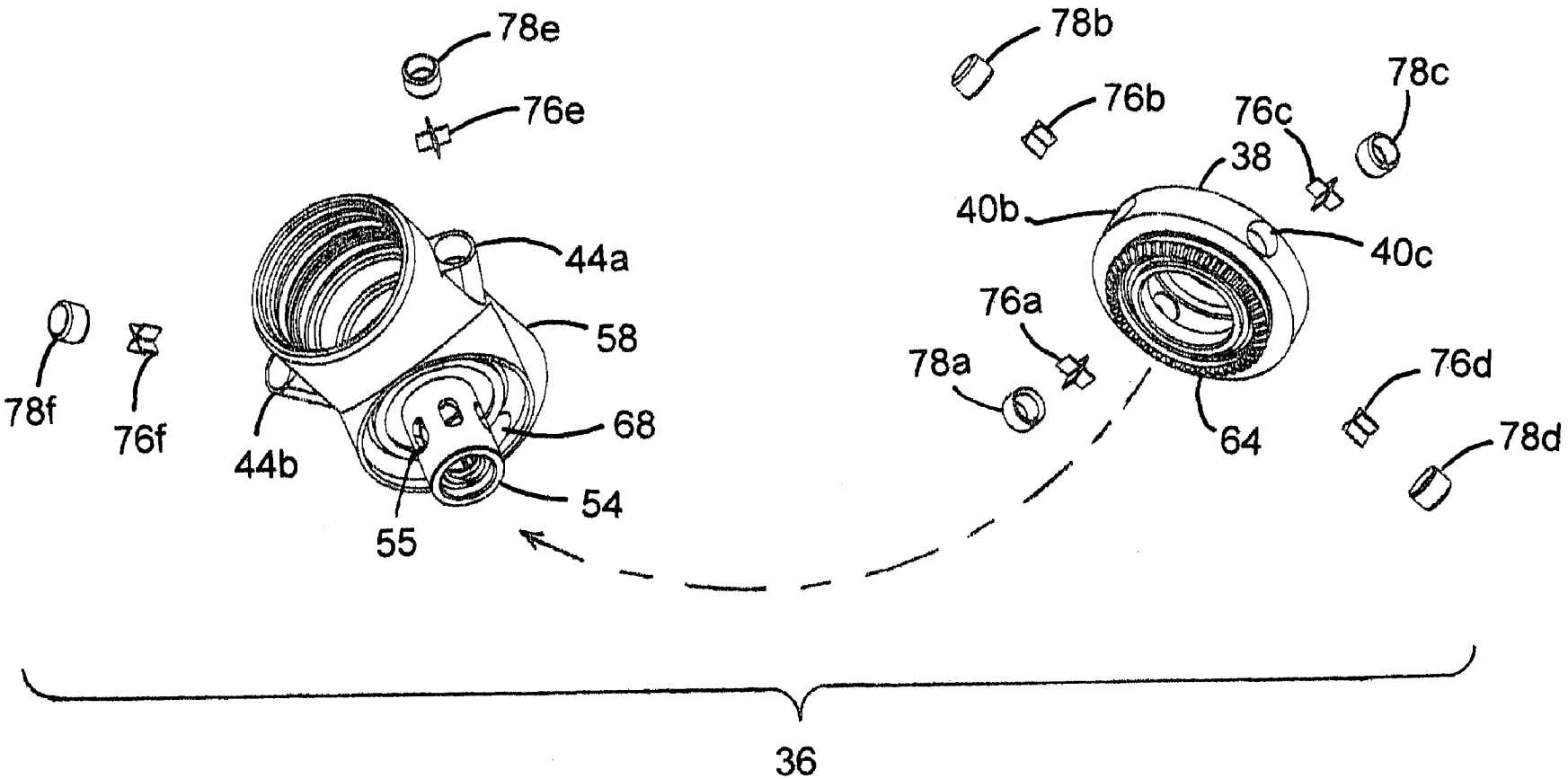
FIG. 8 is an exploded perspective view of the cleaning head of the invention.

Referring now to FIG. 8, an exploded perspective view is shown of rotary cleaning head 36. Tee housing 58 integrally includes downspray nozzles 44*a*, 44*b*. Stream straightener 76*e* and tubular nozzle insert 78*e* are press fitted into nozzle 44*a* as described above. Nozzle housing 38, with bevel gear 64 mounted thereto, is rotatably assembled over cross channel 54 as indicated. A series of oval orifices 55 are formed around the periphery of cross channel 54 to convey the cleaning liquid outward to nozzle housing 38. Stream straighteners 76*a*, 76*b*, 76*c* and 76*d* and tubular nozzle inserts 78*a*, 78*b*, 78*c* and 78*d* are fitted respectively into nozzles 40*a*, 40*b* 40*c* and 40*d* (nozzles 40*a* and 40*d* are not visible), preferably by press fitting. A window 68 is formed in Tee housing 58 to permit second bevel gear 64 to engage first bevel gear 60 (see FIG. 5) and cause nozzle housing 38 to rotate as described.

While the description above discloses the preferred embodiment of the present invention, it is contemplated that numerous variations and modifications of the invention are possible and are considered to be within the scope of the claims that follow.

What is claimed is:

1. Apparatus for cleaning a liquid storage tank, comprising:

a. a tube configured with a channel for conveying a liquid;

b. a shaft assembled within the tube and having a first axis;

c. a first housing assembled rotatably to the tube and caused to rotate around the first axis by the shaft;

d. a nozzle housing mounted to the first housing for being rotated by the shaft around a second axis that is substantially perpendicular to the first axis;

e. a plurality of radial nozzles formed through a periphery of the nozzle housing;

f. a plurality of downspray nozzles mounted to the first housing in a manner to rotate around the first axis, the downspray nozzles each residing substantially coplanar with the first axis;

g. wherein the radial nozzles and the downspray nozzles are in fluid communication with the liquid conveyed within the tube; and h. wherein the first housing and the downspray nozzles rotate around the first axis and the nozzle housing and the plurality of radial nozzles rotate around the second axis.

2. The apparatus for cleaning a liquid storage tank described in claim 1, wherein the downspray nozzles being substantially coplanar with the first axis are each oriented at an acute angle to the first axis.

3. The apparatus for cleaning a liquid storage tank described in claim 1, further comprising means for causing the first housing and the downspray nozzles to rotate around the first axis at a first rotational speed and the nozzle housing and radial nozzles to rotate around the second axis at a second rotational speed.

4. The apparatus for cleaning a liquid storage tank described in claim 1, wherein the plurality of downspray nozzles comprises two nozzles.

5. The apparatus for cleaning a liquid storage tank described in claim 1, further comprising a source of pressurized liquid in fluid communication with the apparatus.

6. The apparatus for cleaning a liquid storage tank described in claim 5, wherein the source of pressurized liquid comprises a pump connected to a suction pipe having a lower end thereof in the tank being cleaned.

7. The apparatus for cleaning a liquid storage tank described in claim 1, wherein the plurality of radial nozzles comprises four nozzles.

8. The apparatus for cleaning a liquid storage tank described in claim 1, further comprising a stream straightener positioned in each of the radial nozzles and each of the downspray nozzles, the stream straightener formed of at least two vanes.

9. The apparatus for cleaning a liquid storage tank described in claim 1, further comprising a tubular nozzle insert positioned in each of the radial nozzles and each of the downspray nozzles.

10. The apparatus for cleaning a liquid storage tank described in claim 9, wherein each of the tubular nozzle inserts is formed with a tapered entry end.

* * * * *